US010485727B2

(12) United States Patent
Grove

(10) Patent No.: US 10,485,727 B2
(45) Date of Patent: Nov. 26, 2019

(54) PISTON ACTUATED LUMBAR STIMULATION DEVICE FOR A CHAIR

(71) Applicant: James E Grove, Marina Del Rey, CA (US)

(72) Inventor: James E Grove, Marina Del Rey, CA (US)

( * ) Notice: Subject to any disclaimer, the term of this patent is extended or adjusted under 35 U.S.C. 154(b) by 402 days.

(21) Appl. No.: 15/376,310

(22) Filed: Dec. 12, 2016

(65) Prior Publication Data

US 2018/0161232 A1 Jun. 14, 2018

(51) Int. Cl.
*A61H 15/00* (2006.01)
*A47C 7/46* (2006.01)

(52) U.S. Cl.
CPC ..... *A61H 15/0078* (2013.01); *A47C 7/462* (2013.01); *A47C 7/467* (2013.01); *A61H 2015/0021* (2013.01); *A61H 2201/0149* (2013.01); *A61H 2201/1246* (2013.01); *A61H 2201/1284* (2013.01); *A61H 2201/1623* (2013.01); *A61H 2201/1654* (2013.01); *A61H 2201/1664* (2013.01);
(Continued)

(58) Field of Classification Search
CPC ..... A61H 1/10; A61H 1/005; A61H 1/006; A61H 1/008; A61H 1/102; A61H 1/0218; A61H 1/0292; A61H 9/0021; A61H 9/005; A61H 9/0071; A61H 15/00; A61H 2015/0007; A61H 2015/0014; A61H 2015/0021; A61H 2015/0028; A61H 2015/0035; A61H 2015/0042; A61H 2015/005; A61H 2015/0064; A61H 23/04; A61H 39/04; A61H 2201/0138; A61H 2201/0149; A61H 2201/1238; A61H 2201/1409; A61H 2201/1623; A61H 2201/1676; A61H 2201/1678; A61H 2201/1695; A61H 2201/5051; A61H 2201/5056; A61H 2203/0425; A61H 2203/1431; A61H 2205/081; A47C 7/40; A47C 7/44; A47C 7/46; A47C 7/462; A47C 7/465; A47C 7/467; B60N 2/66; B60N 2/6671
See application file for complete search history.

(56) References Cited

U.S. PATENT DOCUMENTS 5,452,868 A * 9/1995 Kanigowski ..... B60N 2/6671 244/118.5
9,192,234 B2 * 11/2015 Grove ..... A47C 1/033
(Continued)

*Primary Examiner* — Rachel T Sippel
*Assistant Examiner* — Charles M Vivian
(74) *Attorney, Agent, or Firm* — Morland C. Fischer

(57) ABSTRACT

A chair is disclosed including a seat and a back that is adapted to tilt back with the seat when a user of the chair leans back. A lumbar stimulation device having pairs of massage rollers is attached within the chair back to a gas cylinder bracket that extends vertically through the chair back for attachment to a chair base lying below the chair seat. A push-button actuated gas cylinder is connected to the gas cylinder bracket inside the chair back. A push-button located on one arm of the chair is connected to the gas cylinder by a cable. When the push-button is depressed, the gas cylinder is actuated to generate a pushing force for pushing the pairs of massage rollers of the lumbar stimulation device in a substantially horizontal direction through the chair back to apply a pressure against the user's back.

19 Claims, 6 Drawing Sheets

(52) U.S. Cl.
CPC ..... *A61H 2201/1695* (2013.01); *A61H 2201/5056* (2013.01); *A61H 2203/0431* (2013.01); *A61H 2205/081* (2013.01)

(56) References Cited

U.S. PATENT DOCUMENTS

| | | | | |
|---|---|---|---|---|
| 9,615,993 | B2 * | 4/2017 | Wang | A61H 15/0078 |
| 2003/0055365 | A1 * | 3/2003 | Hazard | A47C 3/0255 601/98 |
| 2005/0148912 | A1 * | 7/2005 | Liao | A61H 15/00 601/99 |
| 2008/0146979 | A1 * | 6/2008 | Brown | A61H 15/00 601/115 |
| 2008/0234613 | A1 * | 9/2008 | Schefthaler | A61H 15/0078 601/100 |
| 2016/0143803 | A1 * | 5/2016 | Portales | A61H 1/02 601/115 |
| 2017/0128320 | A1 * | 5/2017 | Chen | A61H 15/0078 |

* cited by examiner

PISTON ACTUATED LUMBAR STIMULATION DEVICE FOR A CHAIR

BACKGROUND OF THE INVENTION

1. Field of the Invention

This invention relates to a piston actuated lumbar stimulation device that is located inside the back of a chair that rocks back and forth between upright and reclined positions as a user shifts his weight in the chair. The lumbar stimulation device is attached to a gas cylinder bracket that extends vertically within the back of the chair. A push-button controlled gas cylinder is attached to the gas cylinder bracket, and a retractable piston is forced outwardly from the gas cylinder to generate a pushing force for causing the lumbar stimulation device to move towards a user's back to apply a focused massage pressure thereto.

2. Background Art

An individual who is seated in a chair may wish to have a focused pressure applied from the back of the chair to a lower (i.e., lumbar) region of his back to enhance his comfort while seated. In addition to enhancing his comfort, applying a focused pressure to the lower back may stimulate or increase the circulation of blood flow. A conventional chair has no moving parts in the back and, therefore, is incapable of generating a focused pressure to be applied to the lower back of the seated individual. That is, because of the static nature of a typical chair back, especially those common to chairs having a back which reclines when the individual shifts his weight backwards, the individual may experience discomfort in his lower back when he remains seated for a long time. Although electrically powered external attachments are known to be used in combination with a chair back to massage an individual's back, such attachments are frequently expensive, require a source of electrical power to operate, and can become separated from the chair back and misplaced.

Therefore, what would be desirable is a chair having a back that tilts back when a user shifts his weight backwards and within which a lumbar stimulation device is located to apply a focused pressure to the user's lower back without first having to be attached to the chair back or operated from an electrical power source. What would also be desirable is to enable the user to selectively actuate the lumbar stimulation device by depressing a manually accessible push-button.

Reference may be made to my patent application Ser. No. 14/959,994 filed Dec. 4, 2015 for an example of a lumbar stimulation device that is located within the back of a chair and is capable of applying a focused massage pressure against the back of one seated in the chair.

SUMMARY OF THE INVENTION

In general terms, a piston actuated lumbar stimulation device is disclosed to be located inside the back of a chair that rocks back and forth between upright and reclined positions as a user shifts his weight back and forth in the chair. The lumbar stimulation device is capable of applying a focused pressure and improving the circulation of blood flowing through the lower back of the user seated in the chair and leaning backwards. The chair with which the lumbar stimulation device is associated includes a seat that is held above the ground by a base. A gas cylinder that extends between a gas cylinder receiver of the base and a seat plate at the bottom of the seat is operable to adjust the elevation of the seat above the base. The chair also includes a rigid (e.g., plywood) backing that runs through the rear of the chair back and a soft cover that lies opposite the rigid backing at the front of the chair back.

The piston actuated lumbar stimulation device that is located inside the back of the chair includes upper and lower roller carriages that are held one above the other by means of a pair of oppositely aligned carriage coupling plates. Each of the upper and lower miler carriages has a first pair of rollers at the top thereof and a second pair of rollers at the bottom. The upper and lower roller carriages are rotatable relative to one another to conform to the shape of the user's back. The lumbar stimulation device is also rotatable as a unit at an intermediate coupling rod that extends between the opposing carriage coupling plates. Upper ends of a pair of wheel positioning arms are pivotally coupled to the intermediate coupling rod, and the opposite lower ends of the wheel positioning arms are attached to wheels that lie against and roll on the rigid backing at the rear of the chair back.

A Y-shaped gas cylinder bracket extends vertically through the chair back so as to lie between the rigid backing at the rear of the chair back and the soft cover at the front. The bottom of the Y-shaped gas cylinder bracket is connected through the bottom of the chair back by an attachment strap to the gas cylinder below the seat of the chair. The top of the gas cylinder bracket is affixed to the intermediate coupling rod that extends between the carriage coupling plates of the lumbar stimulation device. Therefore, the position of the gas cylinder bracket and the lumbar stimulation device affixed thereto will remain substantially stationary in a vertical direction within the back of the chair. The top of a push-button controlled gas cylinder is connected to the pair of wheel positioning arms by means of a pin that runs through the gas cylinder and between the arms. A threaded retractable piston extends outwardly from the bottom of the push-button controlled gas cylinder to be connected to a gas cylinder support at the gas cylinder bracket. A push-button that is accessible to the user at one of the arms of the chair communicates with the gas cylinder by way of a cable.

When the push-button is depressed, the cable causes the piston to be forced outwardly and downwardly from the bottom of the push-button controlled gas cylinder against the gas cylinder support of the stationary gas cylinder bracket. The gas cylinder moves upwardly to cause a corresponding upward pushing force to be applied to the pair of wheel positioning arms. The wheel positioning arms are thusly rotated upwardly within the chair back and around the intermediate coupling rod to cause the pairs of rollers of the upper and roller carriages to be pushed in a substantially horizontal direction towards the soft cover at the front of the chair back so as to move into contact with the lower back of the user and apply a massage pressure thereto. When the user reclines in the chair and the seat and back tilt back with one another, the chair back will move downwardly relative to the lumbar stimulation device towards the chair base below the seat. Accordingly, the wheels carried by the pair of wheel positioning arms will roll on the downwardly moving rigid backing at the rear of the chair back so that the pairs of rollers of the upper and lower roller carriages of the lumbar stimulation device will appear to the user to be moving upwardly along his back.

DESCRIPTION OF THE PREFERRED EMBODIMENT

Figure 1:
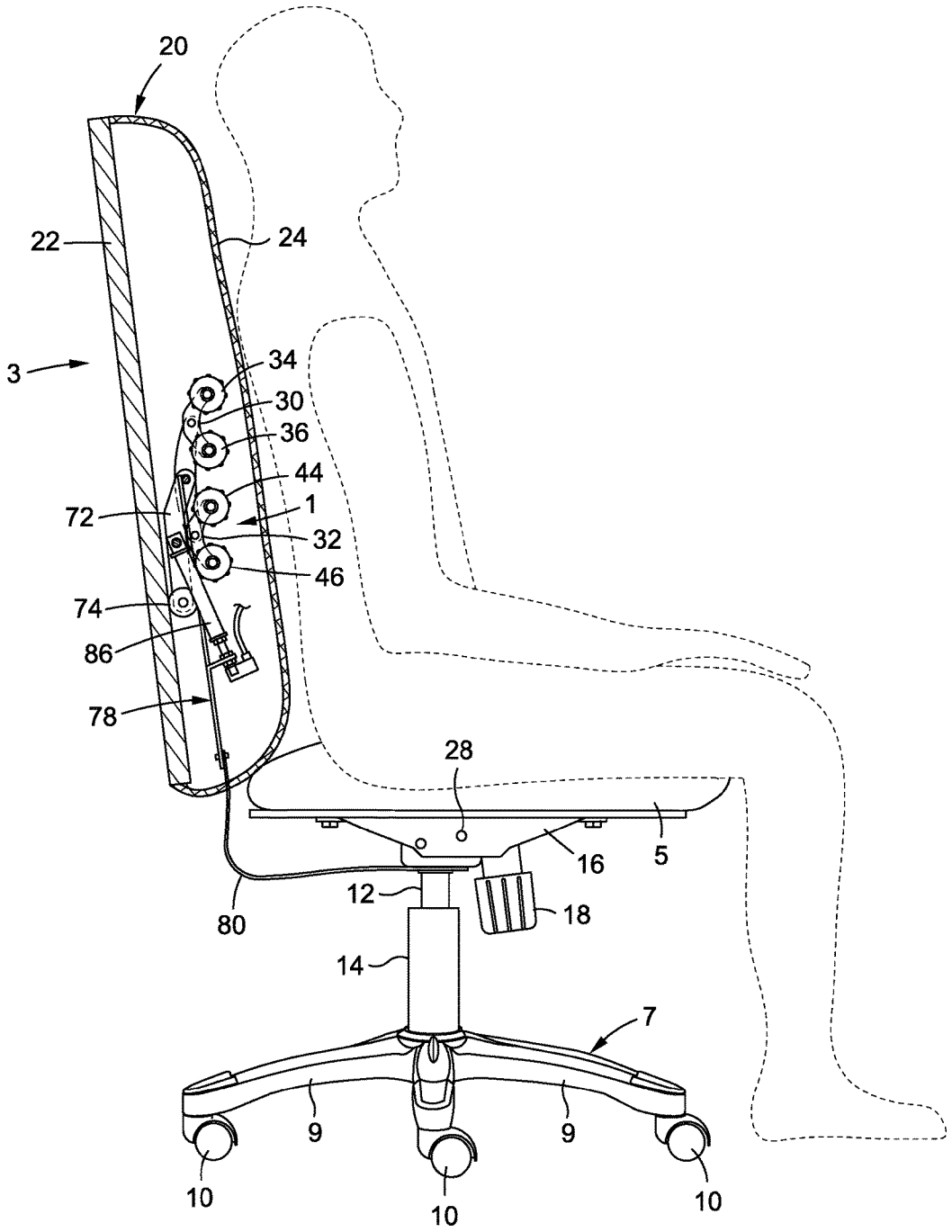
FIG. 1 shows a chair having a seat, a back and a piston actuated lumbar stimulation device according to a preferred embodiment of this invention located inside the chair back and spaced from the back of a user seated in the chair.

Referring initially to FIGS. 1-5 of the drawings, a preferred embodiment is described for a piston actuated lumbar stimulation device 1 for a chair in accordance with the present invention. As will soon be explained, the lumbar stimulation device 1 is capable of applying a focused pressure and improving the circulation of blood flowing through the lower back (e.g. the lumbar area) of one seated in a chair with which the lumbar stimulation device of this invention is associated. Thus, the well-being of the individual seated in the chair may be improved.

The chair 3 with which the lumbar stimulation device 1 is associated is preferably one that tilts as the user shifts his weight in the chair. The chair 3 is of the kind that would commonly be found in a home or office. As in many chairs, the chair 3 includes a seat 5 that is held above the ground by a base 7 having a set of legs 9 to which rollers 10 are attached to permit the chair 3 to be rolled over a flat surface. A gas cylinder 12 extends between a gas cylinder receiver 14 that stands upwardly from the base 7 and a seat plate 16 that lies below the seat 5 of the chair 3. A lever arm (designated 17 and shown in FIG. 5) cooperates with the gas cylinder 12 to enable the elevation of the seat to be adjusted above the base 7 to suit the needs of the user. An adjustment knob 18 which is accessible below the seat plate 16 is rotated to adjust the spring tension of the seat 5 depending upon the size and the weight of the user.

The chair 3 also has a back 20 which stands upwardly from the seat 5. The chair back 20 includes a rigid (e.g., plywood) backing 22 at the rear of the back 20, intermediate filler material (not shown), and a soft (e.g., mesh-like) cover 24 at the front of the back 20 that lies opposite the rigid backing 22. The back 20 is connected to the seat by a pair of arms (designated 26 and best shown in FIG. 5). As the user shifts his weight and leans back against the back 20 of the chair 3, the seat 5 and back 20 of the chair will simultaneously tilt back and rotate around a pivot 28 that runs through the seat plate 16. Thus, the chair back 20 rocks back and forth between an upright position shown in FIG. 1 and a reclined position shown in FIG. 3 depending upon whether the user shifts his weight backwards or forwards in the chair 3.

The piston actuated lumbar stimulation device 1 of this invention is located inside the chair back 20 between the rigid backing 22 at the rear of the chair back 20 and the soft cover 24 at the front. Referring concurrently to FIGS. 1-5 of the drawings, the lumbar stimulation device 1 is shown having an upper roller carriage 30 and a lower roller carriage 32. The upper roller carriage 30 of the lumbar stimulation device 1 includes a first pair of (e.g., plastic) rollers 34 and 35 located at the top thereof and a second pair of rollers 36 and 37 located at the bottom. The first pair of rollers 34 and 35 are connected in spaced axial alignment to one another by a shaft 38 which extends therebetween. The second pair of rollers 36 and 37 are also connected in spaced axial alignment to one another by a shaft 40 which extends therebetween. A set of (e.g., hard plastic) nubs 42 projects outwardly from each roller 34-37 of the first and second pairs of rollers.

Like the upper roller carriage 30, the lower roller carriage 32 of the lumbar stimulation device 1 includes a first pair of (e.g., plastic) rollers 44 and 45 located at the top thereof and a second pair of rollers 46 and 47 located at the bottom. The first pair of rollers 46 and 47 are connected in spaced axial alignment to one another by a shaft 48. The second pair of rollers 46 and 47 are also connected in spaced axial alignment to one another by a shaft 50 which extends therebetween. A set of (e.g., hard plastic) nubs 52 projects outwardly from each roller 44-47 of the first and second pairs of rollers.

Figure 4:
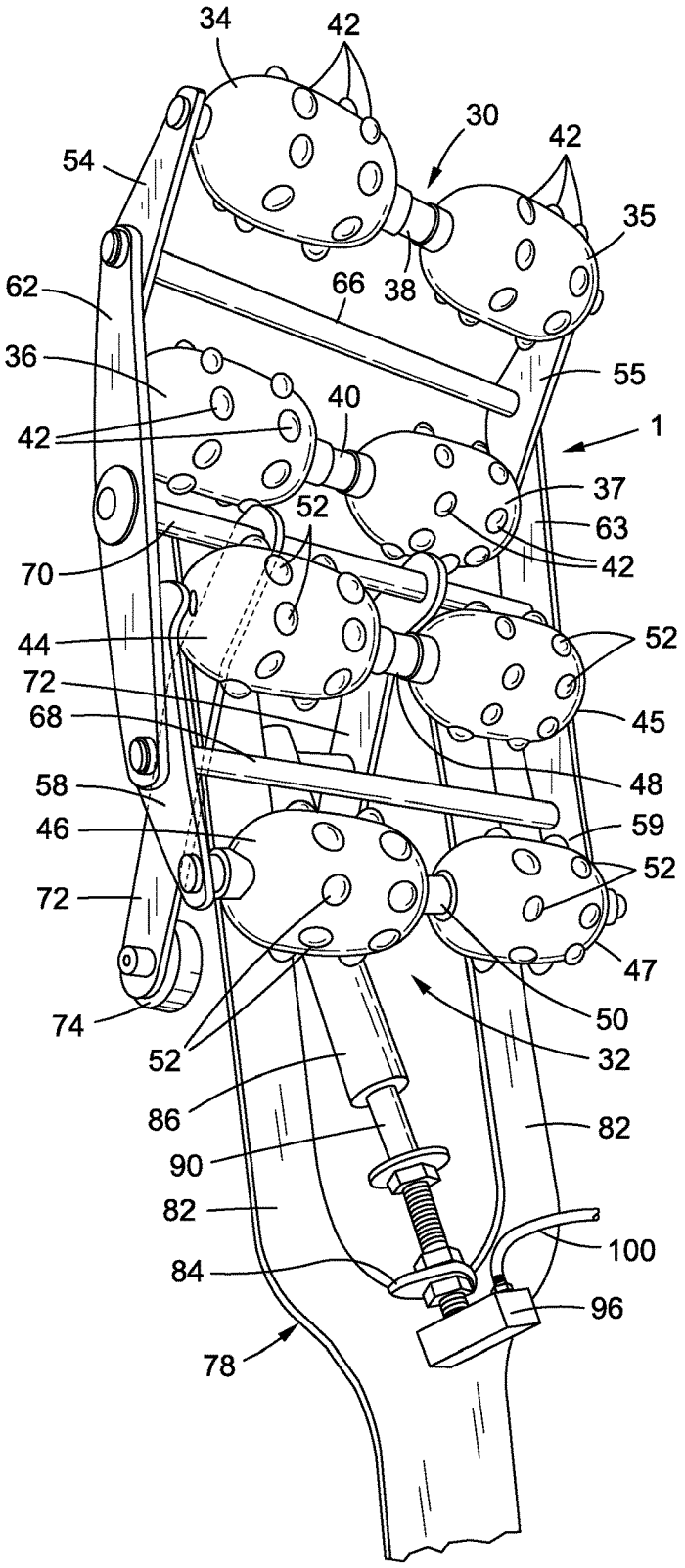
FIG. 4 is a perspective view showing the piston actuated lumbar stimulation device and the push-button controlled gas cylinder coupled thereto by a gas cylinder bracket that extends vertically through the chair back.

As is best shown in FIG. 4, the first pair of rollers 34 and 35 at the top of the upper roller carriage 30 is held above the second pair of rollers 36 and 37 at the bottom by a pair of opposing side plates 54 and 58 that extend therebetween. That is, first ends of the shafts 38 and 40 of the rollers 34 and 36 are rotatably coupled to respective opposite ends of one side plate 54, and the opposite ends of the shafts 38 and 40 of the rollers 35 and 37 are rotatably coupled to respective opposite ends of the other side plate 55. In this manner, the first and second pairs of rollers 34, 35 and 36, 37 of the upper carriage assembly 30 are adapted to rotate with one another relative to the opposing side plates 54 and 55 in response to a rotational force applied to the rollers 34-37.

The first pair of rollers 44 and 45 at the top of the lower roller carriage 32 are held above the second pair of rollers 46 and 47 by a pair of opposing side plates 58 and 59 that extend therebetween. That is, first ends of the shafts 48 and 50 of the rollers 44 and 46 are rotatably coupled to respective opposite ends of one side plate 58, and the opposite ends of the shafts 48 and 50 of the rollers 45 and 47 are rotatably coupled to respective opposite ends of the other side plate 59. In this manner, the first and second pairs of rollers 44, 45 and 46, 47 of the lower roller carriage 32 are adapted to rotate with one another relative to the opposite side plates 58 and 59 in response to a rotational force applied to the rollers 44-47.

The upper and lower roller carriages 30 and 32 of the lumbar stimulation device 1 are interconnected and held one above the other by a pair of oppositely aligned carriage coupling plates 62 and 63 that are located at opposite sides of the device 1. That is, one end of an upper coupling rod 66 runs through one of the side plates 54 of the upper roller carriage 30 (so as to lie between the first and second pairs of rollers 34, 35 and 36, 37 thereof) and the top of a first of the pair of carriage coupling plates 62. The opposite end of the upper coupling rod 66 runs through the other side plate 55 of the upper roller carriage 30 and the top of the opposite one of the pair of carriage coupling plates 63. One end of a lower 68 coupling rod 68 runs through one of the side plates 58 of the lower roller carriage 32 (so as to lie between the first and second pairs of rollers 44, 45 and 46, 47 thereof) and the bottom of the first carriage coupling plate 62. The opposite end of the lower coupling rod 68 runs through the other side plate 59 of the lower carriage assembly 30 and the bottom of the opposite carriage coupling plate 63.

An intermediate coupling rod 70 extends between the pair of oppositely aligned carriage coupling plates 62 and 63 so as to lie between the upper and lower roller carriage 30 and 32. By virtue of the opposing carriage coupling plates 62 and 63 and the upper, lower and intermediate coupling rods 66, 68 and 70 that extend therebetween, the upper and lower roller carriages 30 and 32 of the lumbar stimulation device 1 are adapted to rotate relative to one another at the upper and lower coupling rods 66 and 68. Likewise, and to provide one seated in the chair 3 with maximum lumbar stimulation, the upper and lower roller carriages 30 and 32 are also adapted to rotate together as a unit at the intermediate coupling rod 70 depending upon the forces that are applied to the lumbar stimulation device 1. In this manner, the roller carriages 30 and 32 can be positioned within the chair back 20 to conform to the shape of the back of the user seated in the chair.

As is also best shown in FIG. 4, the lumbar stimulation device 1 includes a pair of wheel positioning arms 72 which lie within the chair back 20 between the pair of side plates 58 and 59 of the lower roller carriage 32. The tops of the wheel positioning arms 72 are pivotally coupled in surrounding engagement with the intermediate coupling rod 70 that extends between the oppositely aligned carriage coupling plates 62 and 63. A wheel 74 is rotatably coupled to the bottom of each wheel positioning arm 72. As will soon be disclosed, depending upon a gas cylinder generated pushing force to be applied thereto, the wheel positioning arms 72 are adapted to rotate around the intermediate coupling rod 70 to correspondingly cause the lumbar stimulation device 1 to move through the chair back 20 and towards the back of the user.

Figure 2:
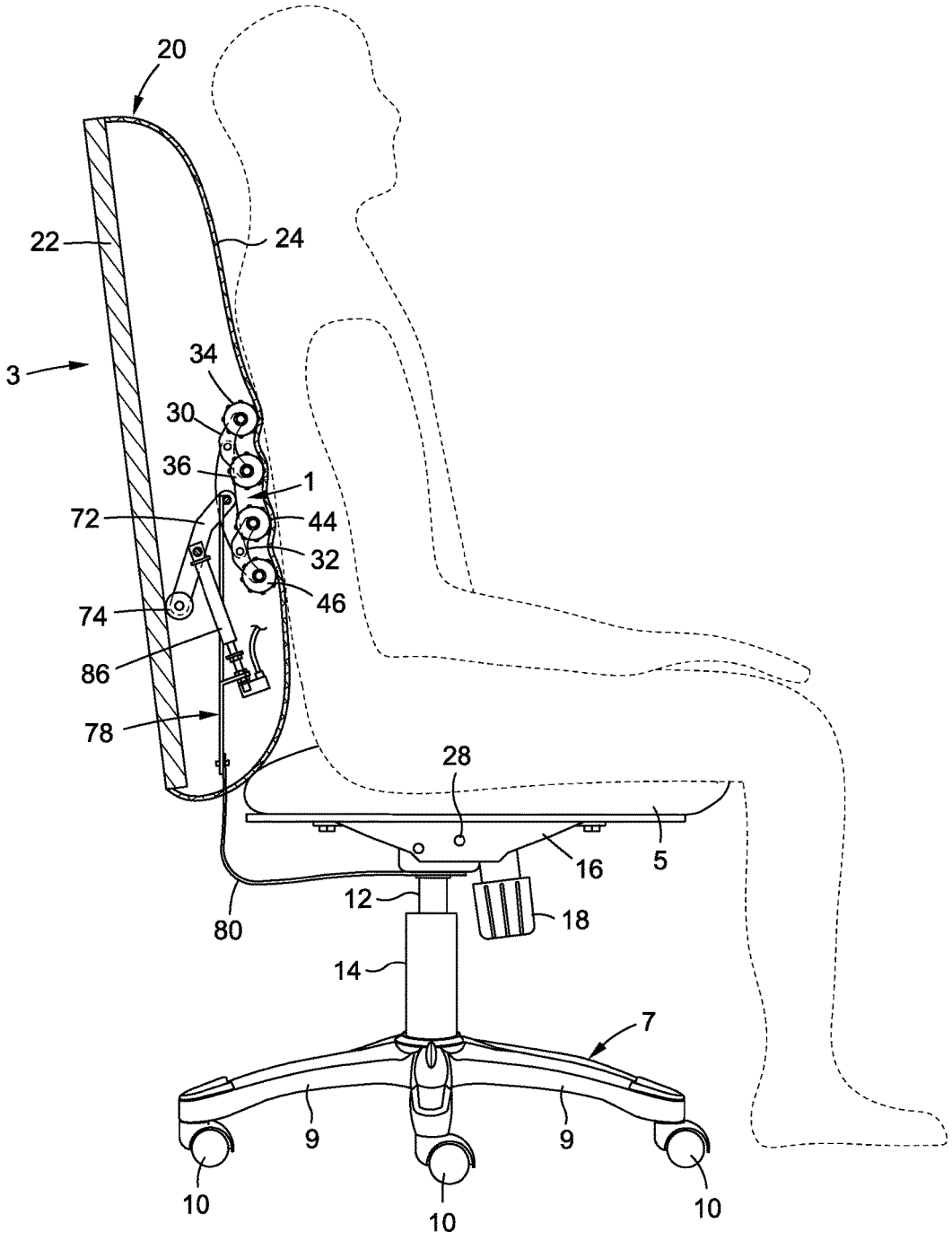
FIG. 2 shows the chair of FIG. 1 with the piston actuated lumbar stimulation device being pushed against the user's back by a retractable piston that is forced outwardly from a push-button controlled gas cylinder that is coupled to the lumbar stimulation device within the chair back.
Figure 3:
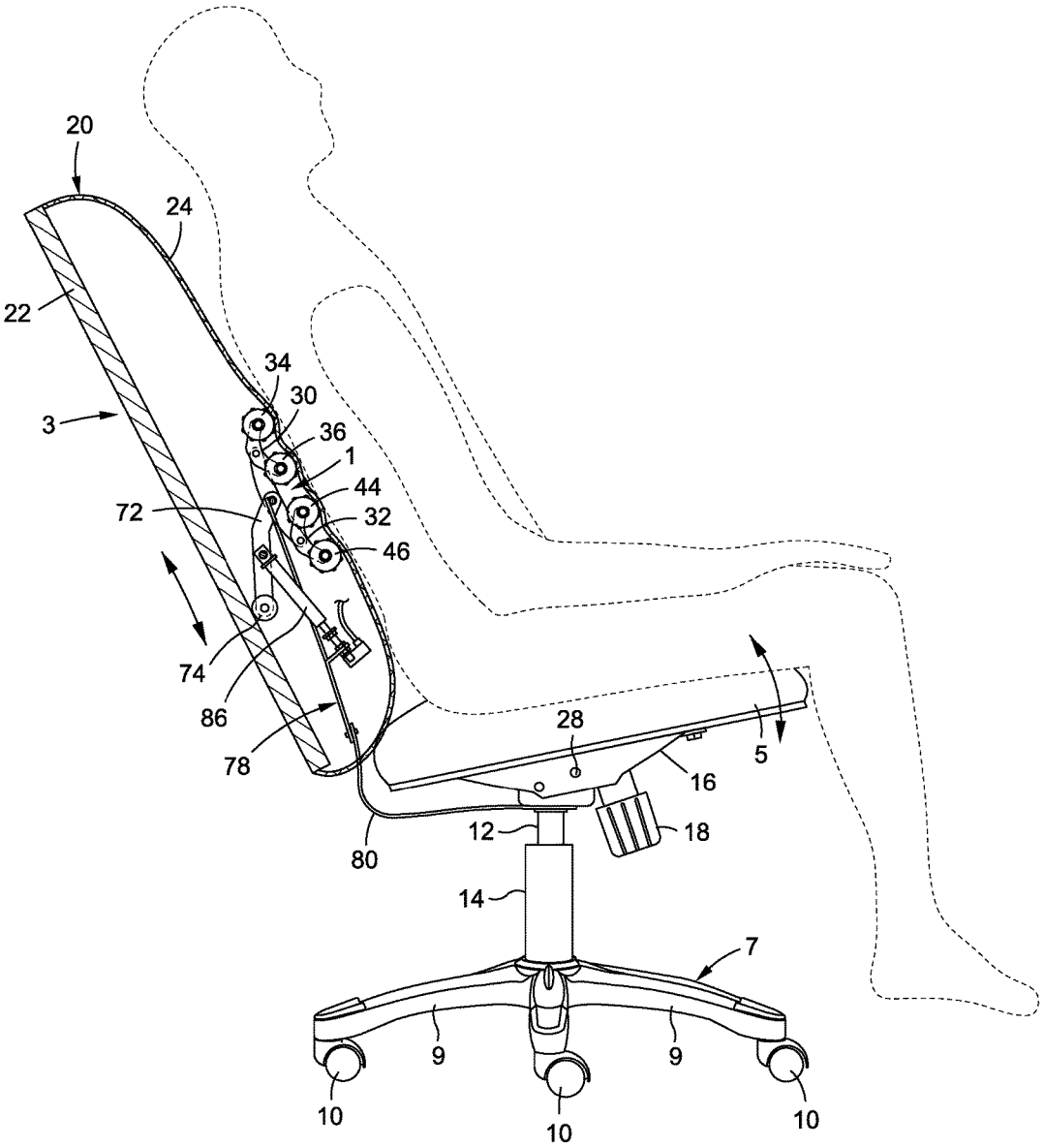
FIG. 3 shows the chair of FIG. 2 with the piston actuated lumbar stimulation device applying pressure against the user's back when the chair back and the chair seat tilt back and the chair back moves downwardly relative to the lumbar stimulation device.

To this end, and continuing to refer to FIGS. 1-5 of the drawings, a flexible, generally Y-shaped gas cylinder bracket 78 is shown located between the piston actuated lumbar stimulation device 1 within the back 20 of the chair 3 and the bottom of the seat 5 of chair 3. As is best shown in FIGS. 1-3, the gas cylinder bracket 78 runs vertically through the chair back 20 alongside the rigid backing 22. Located below the seat plate 28 of the chair 3 is a relatively stiff attachment strap 80. One of the attachment straps 80 is connected to the base 7 below the seat 5 of chair 3 in surrounding engagement with the gas cylinder 12. The opposite end of the attachment strap 80 turns upwardly above the chair seat 5 so as to be connected through the bottom of the chair back 20 to the bottom of the Y-shaped gas cylinder bracket 78 by which the bracket 78 is held in place within chair back 20.

As is best shown in FIG. 4, the top of the Y-shaped gas cylinder bracket 78 includes a pair of upstanding spaced, parallel aligned bracket arms 82 that lie within the chair back 20 between the rigid backing 22 and the soft cover 24. The bracket arms 82 are affixed (e.g., welded) to the intermediate coupling rod 70 that extends between the carriage coupling plates 62 and 63 at opposite sides of the lumbar stimulation device 1. Thus, the lumbar stimulation device 1 is held in place within the chair back 20 by the connection of the bracket arms 82 to the intermediate coupling rod 70. The spaced bracket arms 82 run downwardly through the chair back 20 and come together at a point where the top and the bottom of the Y-shaped gas cylinder bracket 78 join one another.

Located adjacent the point where the bracket arms 82 at the top of the gas cylinder bracket 78 join the bottom of the bracket is an outwardly (i.e., forwardly) extending gas cylinder support 84. A push-button controlled gas cylinder 86 is connected to the gas cylinder bracket 78 at the gas cylinder support 84 thereof. The gas cylinder 86 is also connected to the pair of wheel positioning arms 72 to impart an upward pushing force thereto for causing the lumbar stimulation device 1 to be moved in a generally horizontal direction through the back 20 of the chair 3 and towards the back of one seated in the chair so that the rollers 34-37 and 44-47 of the upper and lower roller carriages 30 and 34 of device 1 will press against and roll on the user's back to apply a focused massage pressure thereto.

The push-button controlled gas cylinder 86 is conventional, and the operation thereof is similar to the operation of the gas cylinder 12 that is located below the seat plate 16 to elevate the seat 5 of the chair 3. Referring now to FIGS. 5-9 of the drawings, the gas cylinder 86 is shown having a tubular body 88 that is pressurized by air. A threaded retractable piston 90 extends outwardly from the bottom of the tubular body 88 to be fixedly attached to the gas cylinder bracket 78 at the gas cylinder support 84 thereof. The top of the tubular body 88 of gas cylinder 86 is received between and coupled to each of the pair of wheel positioning arms 72 by means of a pin 92 that runs through the cylinder body 88 and between the arms 72.

Figure 5:
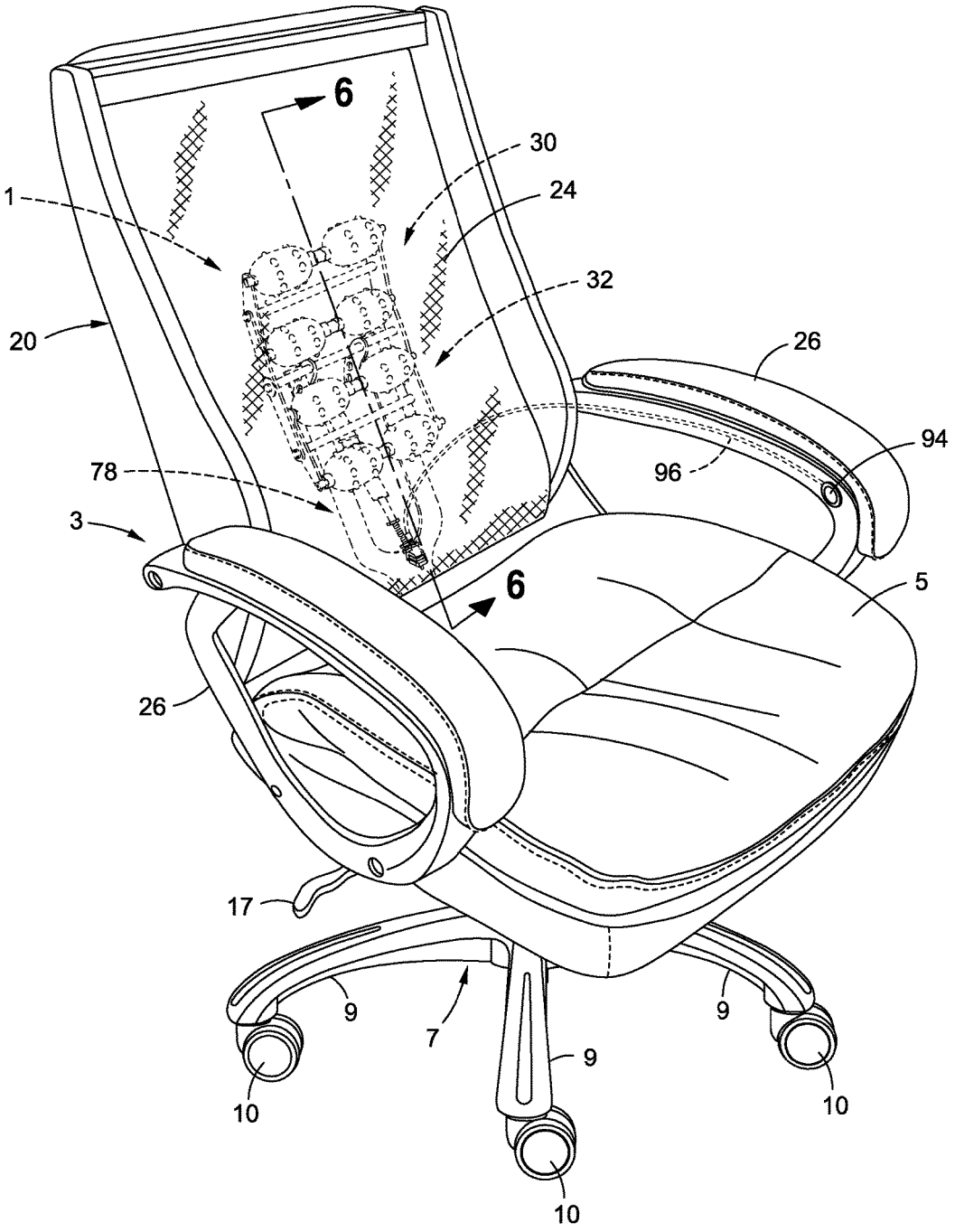
FIG. 5 is a perspective view of the chair showing a push-button located at one arm of the chair and communicating by a cable with the push-button controlled gas cylinder that is coupled to the piston actuated lumbar stimulation device within the back of the chair.

As is best shown in FIG. 5, a push-button 94 is accessible to the user seated on the chair 3. By way of example, the push-button 94 is mounted on one of the arms 26 at one side of the seat 5 of chair 3. The push-button 94 communicates with a switch valve 96 of the push-button controlled gas cylinder 86 (best shown in FIGS. 6 and 7) by way of a cable 100 that runs through the chair arm 26 and into the chair back 20. When the user depresses the push-button 94, the cable 100, which is coupled to the pressurized gas cylinder 86 by way of the switch valve 96, causes a pin (not shown) to be displaced, whereby the retractable piston 90 is forced outwardly and downwardly from the bottom of the cylinder body 88.

Figure 6:
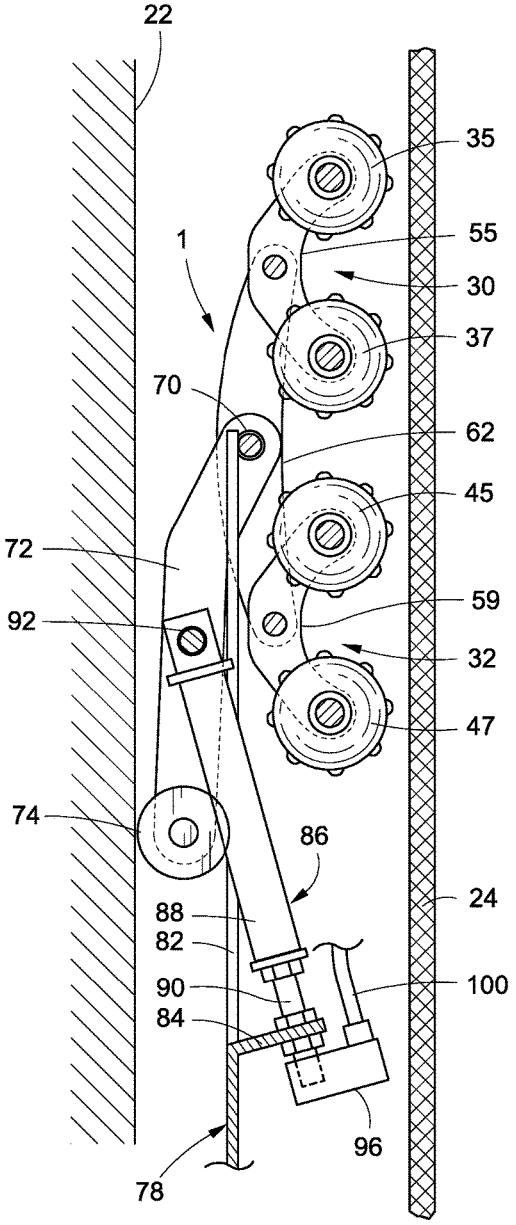
FIG. 6 is a cross-section of the back of the chair taken along lines 6-6 of FIG. 5 showing the piston actuated lumbar stimulation device located inside the chair back and spaced from the user's back when the retractable piston of the push-button controlled gas cylinder is retracted inwardly thereof.
Figure 7:
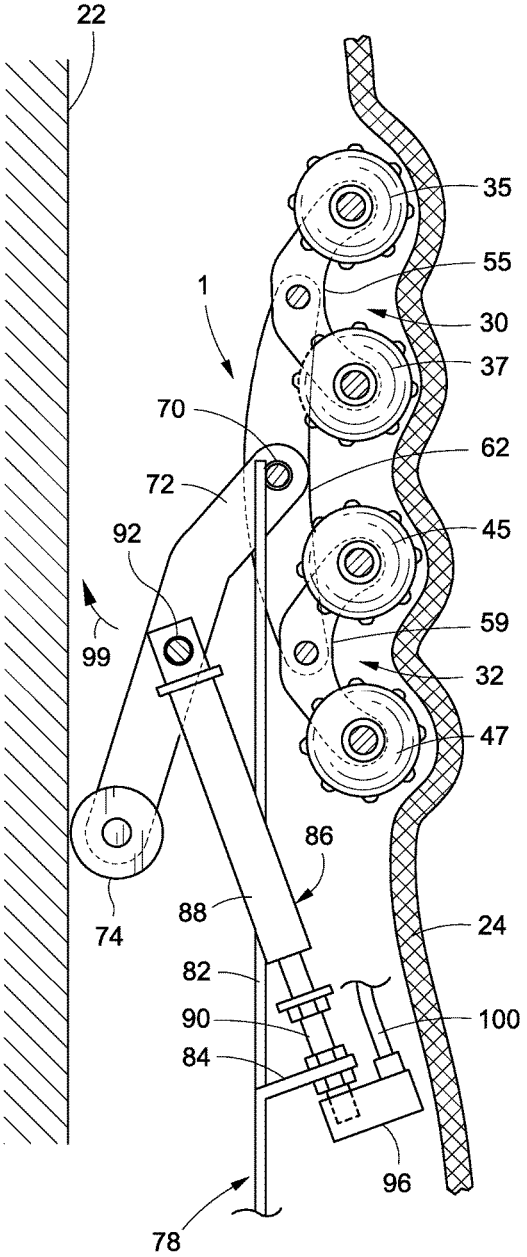
FIG. 7 is a cross-section of the back of the chair showing the piston actuated lumbar stimulation device pushed towards and applying a pressure against the user's back when the push-button is depressed and the retractable piston is forced outwardly from the push-button controller gas cylinder.

FIGS. 1 and 6 show the piston actuated lumbar stimulation device 1 at rest with the back 20 of the chair 3 tilted forward and standing erect prior to the depression of the push-button 94 (of FIG. 5). The piston 90 is retracted within the cylinder body 88, and the lumbar stimulation device 1 is spaced rearwardly from each of the soft cover 24 at the front of the chair back 20 and the back of the user seated on the chair. In FIGS. 2 and 7, with the chair back 20 still tilted forward and standing erect, the push-button 94 is now depressed. Accordingly, the piston 90 is forced outwardly from the tubular body 88 of the gas cylinder 86, and the pair of wheel positioning arms 72 rotate upwardly and around the intermediate coupling rod 70 so that the lumbar stimulation device 1 is pushed towards the soft cover 24 and pressed against the user's back.

More particularly, and as was previously described, the piston 90 is fixedly connected to the Y-shaped gas cylinder bracket 78 at the gas cylinder support 84 thereof. The gas cylinder bracket 78, which stands upwardly and is held in place within the chair back 20 by its attachment to the gas cylinder 12 at the chair base 7 below the chair seat 5 by way of the attachment strap 80 (of FIG. 2), remains at all times substantially stationary in the vertical direction within the chair back 20. Likewise, the lumbar stimulation device 1 which is connected to the top of the gas cylinder bracket 78 (at the intermediate coupling rod 70) remains substantially stationary within the chair back 20 in the vertical direction. As the piston 90 is driven outwardly and downwardly from the bottom of the cylinder body 88, an opposite upward driving force causes the cylinder body 88 to move upwardly towards the pair of wheel positioning arms 72. Thus, a linear pushing force is applied from the top of the cylinder body 88 to the wheel positioning arms 72 at the pin 92 that extends through the cylinder body 88 and between the wheel positioning arms 72. The wheel positioning arms 72 are therefore caused to rotate (in the direction of the reference arrow 98 of FIG. 7) upwardly and around the intermediate coupling rod 70.

Accordingly, the wheels 74 that are carried at the bottoms of the wheel positioning arms 72 are pushed against the rigid backing 22 at the rear of the chair back 20. At the same time, the upper and lower roller carriages 30 and 32 of the lumbar stimulation device 1 that are coupled to the top of the wheel positioning arms 72 at the intermediate coupling rod 70 are pushed in a substantially horizontal direction towards and against the soft cover 24 at the front of the chair back 20 at which to engage the user's back and apply a focused pressure thereto.

When the user shifts his weight and leans back against the back 20 of the chair 3 (best shown in FIG. 3), the back 20 and seat 5 of chair 3 tilt back with one another around the pivot 28 through the seat plate 16 below seat 5. In this regard, the back 20 and the seat 5 will remain aligned perpendicular to one another whether the chair back 20 is tilted forwards or backwards. As the chair back 20 tilts back, the flexible gas cylinder bracket 78 is bent back. The force generated by the user's back will cause the chair back 20 to be pushed downwardly towards the chair base 7. In other words, the rigid backing 22 and the soft cover 24 of the back 20 of the chair 3 will move downwardly together relative to each one of the substantially stationary (in the vertical direction) gas cylinder bracket 78 and the piston actuated lumbar stimulation device 1 that is attached to the bracket 78 within the chair back 20 at the intermediate coupling rod 70 that extends between the oppositely aligned carriage coupling plates 62 and 63.

In this case, the wheels 74 that are carried at the bottoms of the wheel positioning arms 72 will roll on the rigid backing 22 which moves downwardly with the chair back 20 when the user leans back in the chair 3. Although the rollers 35-37 and 45-47 of the upper and lower roller carriages 30 and 32 of the lumbar stimulation device 1 are held within the chair back 20 by the stationary gas cylinder bracket 78 and do not actually move in the vertical direction, it will appear to the user as if the rollers 35-37 and 45-47 are otherwise moving upwardly along his back to enhance his comfort.

As was explained above, when the chair back 20 stands erect and the user depresses the push-button 94 so that the pressurized air within the body 88 of the gas cylinder 86 is released to cause the retractable piston 90 to move outwardly and downwardly from the cylinder body 88, the lumbar stimulation device 1 is moved horizontally towards and against the back of the user. When the chair back 20 tilts back, the user can once again depress the push-button 94 as his back moves rearwardly and pushes against the upper and lower roller carriages 30 and 31 of the lumbar stimulation device 1 by which the gas cylinder 86 will be recharged (i.e., repressurized) with air and the retractable piston 90 thereof will be retracted inwardly of the piston body 88.

It may be appreciated that the position of the rollers 35-37 and 45-47 of the upper and lower roller carriages 30 and 32 within the chair back 20 as well as the pressure being applied by the lumbar stimulation device 1 against the back of the user can be selectively controlled depending upon the time during which the push-button 94 is depressed and the upward travel of the body 88 of the push-button controlled gas cylinder 86. That is to say, as long as the push-button 94 is depressed, the piston 90 will continue to be pushed outwardly and downwardly from the cylinder body 88, and the pair of wheel positioning arms 72 will continue to be rotated upwardly for causing the lumbar stimulation device 1 to be advanced towards and into contact with the back of the user.

The invention claimed is:

1. A chair comprising:

a chair seat to support the weight of a user adapted to be seated in the chair;

a chair base to hold the chair seat above the ground;

a chair back standing upwardly from the chair seat above the chair base and tilting backwards when the user leans back against the chair back;

a gas cylinder bracket having first and opposite ends and extending vertically inside the chair back, the first end of said gas cylinder bracket attached to the chair base;

a lumbar stimulation device located inside the chair back and attached to the opposite end of said gas cylinder bracket to apply pressure to the back of the user when the user leans back against the chair back;

a gas cylinder located inside the chair back and connected between said gas cylinder bracket and said lumbar stimulation device, said gas cylinder adapted to be actuated by the user to cause a pushing force to be applied from said gas cylinder to said lumbar stimulation device, whereby said lumbar stimulation device is adapted to be moved against the user's back to apply the pressure thereto; and at least one , pushing arm having first and opposite ends, the first end of said at least one pushing arm connected to said lumbar stimulation device and the opposite end of said at least arm connected to a pushing arm roller, said at least one pushing Mil located within said chair back and coupled to said lumbar stimulation device to position said lumbar stimulation device relative to said back of the user, said gas cylinder including a gas filled body having first and opposite ends, the first end of said gas cylinder body connected to said at least one pushing arm, and the opposite end of said gas cylinder body having a retractable piston extending outwardly therefrom and fixedly connected to said gas cylinder bracket, the actuation of said gas cylinder by the user causing said retractable piston to move outwardly and downwardly from the opposite end of said gas cylinder body for generating a corresponding upwardly pushing force against said at least one pushing arm such that said at least one pushing arm pushes said lumbar stimulation device towards and against the back of the user;

said chair back having a relatively soft front against which the back of the user seated in the chair is positioned when in use and a relatively rigid rear lying opposite said relatively soft front, the pushing arm roller that is connected to the opposite end of said at least one pushing arm lying on the relatively rigid rear of said chair back and adapted to roll thereon.

2. The chair recited in claim 1, further comprising a manually accessible push-button located on said chair and a cable connected between said push-button and said gas cylinder, said push-button configured to be depressed to cause said cable to exert a pulling force o said gas cylinder by which said gas cylinder is actuated and said lumbar stimulation device is adapted to be moved against the user's back to apply the pressure thereto.

3. The chair recited in claim 2, further comprising a pair of chair arms located at respective opposite sides of said chair seat, said push-button attached to one of said pair of chair arms.

4. The chair recited in claim 1, wherein said chair back and the relatively rigid rear thereof move downwardly with one another towards said chair base in response to the user leaning back against the chair back and said chair back tilting backwards, such that the pushing arm roller connected to the opposite end of said at least one pushing arm rolls on the relatively rigid rear of the chair back when said char back and said rigid rear thereof move downwardly to towards said chair base.

5. The chair recited in claim 4, further comprising an attachment strap running below the chair seat and connected between the first end of said gas cylinder bracket and the chair base, said attachment strap holding said gas cylinder bracket substantially stationary in a vertical direction within said chair back as said chair back moves downwardly towards said chair base, such that said chair back moves downwardly relative to said gas cylinder bracket.

6. The chair recited in claim 5, wherein the chair base includes a set of legs configured to lie on the ground and a seat lifting gas cylinder connected to said chair base to generate a lifting force by which to lift the chair seat relative to the ground, said attachment strap being connected to the seat lifting gas cylinder of said chair base.

7. The chair recited in claim 5, wherein the chair seat is connected to the chair back so that said chair seat tilts downwards towards the attachment strap that runs below the chair seat at the same time that the chair back tilts backwards and moves downwardly towards said chair base.

8. The chair recited in claim 1, wherein said lumbar stimulation device includes at least one upper back massage roller having first and opposite sides, at least one lower back massage roller having first and opposite sides, a first coupling plate extending between the respective first sides of said at least one upper and said at least one lower back massage rollers, a second coupling plate extending between the respective opposite sides of said at least one upper and said at least one lower massage rollers, and a coupling rod located between said at least one upper and, said at least one lower back massage rollers and connected between said first and second coupling plates, the first end of said at least one pushing arm being pivotally connected to said lumbar stimulation device at said coupling rod thereof.

9. The chair recited in claim 8, wherein said at least one upper and said at least one lower back massage rollers are rotatable with one another and with said first and second coupling plates relative to said coupling rod that is connected between the first and second coupling plates of said lumbar stimulation device.

10. The chair recited in claim 8, wherein the opposite end of said gas cylinder bracket is fixedly connected to said coupling rod that is connected between the first and second coupling plates of said lumbar stimulation device.

11. The chair recited in claim 8, wherein said at least one pushing arm is rotatable upwardly within said chair back and around said coupling rod that is connected between the first and second coupling plates of said lumbar stimulation device in response to the actuation of said gas cylinder by the user, said at least one pushing arm pushing said lumbar stimulation device in a substantially horizontal direction through said chair back and against the back of the user when in use to apply the pressure thereto.

12. A chair comprising:

a chair seat to support the weight of a user adapted to be seated in the chair;

a chair base to hold the chair seat above the ground;

a chair back standing upwardly from the chair seat above the chair base and tilting backwards when the user leans back against the chair back, said chair back moving downwardly towards said chair base in response to the user leaning back and the chair back tilting backwards;

a gas cylinder bracket having first and opposite ends and extending vertically inside the chair back, the first end of said gas cylinder bracket attached to said chair base such that the position of said gas cylinder bracket within the chair back is held substantially stationary in a vertical direction;

a lumbar stimulation device located inside the chair back and attached to the opposite end of said gas cylinder bracket to apply pressure to the back of the user when the user leans back against the chair back, said lumbar stimulation device including at least one upper back massage roller haying first and opposite sides, at least one lower back massage roller having first and opposite sides, a first coupling plate extending between the respective first sides of said at least one upper and said at least one lower back massage rollers, a second coupling plate extending between the respective opposite sides of said at least one upper and said at least one lower back massage rollers, and a coupling rod located between said at least one upper and said at least one lower back massage rollers and connected between said first and second coupling plates;

a pushing arm located within said chair back and being connected to said lumbar stimulation device to apply a pushing force thereto and thereby adapted to move said lumbar stimulation device within said chair back relative to the back of the user, said pushing arm having, first and opposite ends, the first end of said pushing arm being pivotally connected to the coupling rod of said lumbar stimulation device, and the opposite end of said pushing arm being connected to a wheel, said chair back having a rigid surface such that the wheel to which the opposite end of said pushing arm is connected lies on the rigid surface of said chair back and rolls thereon when said chair back tilts backwards and moves downwardly towards said chair base; and a gas cylinder located inside the chair back and connected between said gas cylinder bracket and said pushing arm, said gas cylinder being actuated to generate the pushing force to be applied by way of said pushing arm to said lumbar stimulation device at said coupling rod thereof, whereby said lumbar stimulation device is moved by said gas cylinder in a substantially horizontal direction through said chair back towards and against the user's back when in use to apply the pressure thereto while said lumbar stimulation device that is attached to said gas cylinder bracket remains substantially stationary in the vertical direction relative to said downwardly moving chair back.

13. The chair recited in claim 12, further comprising a manually accessible push-button located on said chair and a cable connected between said push-button and said gas cylinder, said push-button configured to be depressed to cause said cable to exert a pulling force on said gas cylinder by which said gas cylinder is actuated and said lumbar stimulation device is moved against the user's back when in use to apply the pressure thereto.

14. The chair recited in claim 13, further comprising a pair of chair arms located at respective opposite sides of said chair seat, said push-button attached to one of said pair of chair arms.

15. The chair recited in claim 12, wherein said gas cylinder includes a gas filled body having first and opposite ends, the first end of said gas cylinder body connected to said pushing arm, and the opposite end of said gas cylinder body having a retractable piston extending outwardly therefrom and fixedly connected to said gas cylinder bracket, the actuation of said gas cylinder by the user when it use causing said retractable piston to move outwardly and downwardly from the opposite end of said gas cylinder body for generating the pushing force upwardly against said pushing arm such that said pushing arm is adapted to push said lumbar stimulation device towards and against the back of the user.

16. The chair recited in claim 12, wherein said at least one upper back massage roller and said at least one lower back massage roller are rotatable with one another and with said first and second coupling plates relative to said coupling rod that is connected between the first and second coupling plates of said lumbar stimulation device.

17. The chair recited in claim 12, wherein said pushing arm is rotatable upwardly within said chair back and around said coupling rod that is connected between the first and second coupling plates of said lumbar stimulation device in response to the actuation of said gas cylinder by the user when in use, said pushing arm pushing said lumbar stimulation device in a substantially horizontal direction through said chair back and against the back of the user when in use to apply the pressure thereto.

18. A chair comprising:

a chair seat to support the weight of a user adapted to be seated in the chair;

a chair base to hold the chair seat above the ground;

a chair back standing upwardly from the chair seat above the chair base and tilting backwards when the user leans back against the chair back, said chair back moving downwardly towards said chair base in response to the user leaning back and the chair back tilting backwards;

a gas cylinder bracket having first and opposite ends and extending vertically inside the chair back, the first end of said gas cylinder bracket attached to the chair base;

a lumbar stimulation device located inside the chair back and attached to the opposite end of said gas cylinder bracket to apply pressure to the back of the user when the user leans back against the chair back;

a gas cylinder located inside the chair back and connected between said gas cylinder bracket and said lumbar stimulation device, said gas cylinder adapted to be actuated by the user to cause a pushing force to be applied from said gas cylinder to said lumbar stimulation device, whereby said lumbar stimulation device is adapted to he moved against the user's back to apply the pressure thereto; and an attachment strap lying below the chair seat and connected between the first end of said gas cylinder bracket and the chair base, said attachment strap holding said gas cylinder bracket substantially stationary in a vertical direction within said chair back as said chair back moves downwardly towards said chair base, such that said chair back moves downwardly towards said chair back relative to said gas cylinder bracket.

19. The chair recited in claim 18, wherein the chair seat is connected to the chair back so that said chair seat tilts downwards towards the attachment strap that lies below the chair seat at the same time that the chair back tilts backwards and moves downwardly towards said chair base.

* * * * *